United States Patent [19]

Potter

[11] Patent Number: 4,501,508

[45] Date of Patent: Feb. 26, 1985

[54] APPARATUS FOR USE IN AUTOMATIC TYPING MACHINE

[75] Inventor: John T. Potter, Locust Valley, N.Y.

[73] Assignee: Iquad Company Incorporated, Locust Valley, N.Y.

[21] Appl. No.: 479,633

[22] Filed: Mar. 28, 1983

Related U.S. Application Data

[63] Continuation-in-part of Ser. No. 310,189, Oct. 9, 1981, Pat. No. 4,440,038, and a continuation-in-part of Ser. No. 407,481, Aug. 13, 1982, Pat. No. 4,423,970, and a continuation of Ser. No. 190,680, Sep. 24, 1980, abandoned.

[51] Int. Cl.[3] ..... B41J 1/32

[52] U.S. Cl. ..... 400/141.1; 400/320; 400/352; 400/354; 400/355

[58] Field of Search ..... 400/141, 141.1, 320, 400/352, 354, 355, 357, 692

[56] References Cited

U.S. PATENT DOCUMENTS

| | | | |
|---|---|---|---|
| 3,310,147 | 3/1967 | Clary et al. | 400/174 X |
| 3,757,922 | 9/1973 | Sweeney | 400/328 X |
| 3,892,303 | 7/1975 | Willcox | 400/142 X |
| 4,400,105 | 8/1983 | Yeager et al. | 400/692 X |

*Primary Examiner*—Paul T. Sewell

*Attorney, Agent, or Firm*—Nolte, Nolte and Hunter

[57] ABSTRACT

A typewriter printing assembly is disclosed in which a typing assembly and type actuator are mounted for movement along a shaft and are connected to a follower. The connection of the typing assembly and follower is a detachable one, and the support for the shaft is removable for facile assembly and disassembly of the typing assembly on the shaft. The type actuator comprises a light interfitting assembly of the type hammer and support formed to accommodate the shaft and for straight line movement of the hammer when activated.

7 Claims, 4 Drawing Figures

APPARATUS FOR USE IN AUTOMATIC TYPING MACHINE

This application is a CIP of Ser. No. 310,189, filed Oct. 9, 1981, now U.S. Pat. No. 4,440,038 and a CIP of Ser. No. 407,481, filed Aug. 13, 1982, now U.S. Pat. No. 4,423,970 and a continuation of Ser. No. 190,680, filed Sept. 24, 1980, abandoned.

BACKGROUND OF THE INVENTION

The present invention relates to automatic typing machines and, specifically, relates to linkages and apparatus for use in permitting such automatic typing machines to operate at high speed.

In my co-pending application Ser. No. 407,481, filed Aug. 13, 1982, an automatic typing machine of the kind having rings containing individual type elements is disclosed. That invention involves a system to rotate the rings to the desired type element and actuate a hammer assembly to strike the type element, thereby providing a printed impression on the paper. In that system, the type ring assembly rides along the length of a splined shaft with rotational motion being imparted to the rings by turning the shaft with a servo-motor, under control of an onboard computer. Longitudinal position of the typing mechanism is determined by a lead screw and follower assembly that is the subject of my co-pending patent application Ser. No. 310,189, filed Oct. 9, 1981. These inventions described in the above-identified applications form no part of the present invention, however, the present invention teaches improved linkages and mounting assemblies that are particularly useful in this automatic typing machine.

SUMMARY OF THE INVENTION

The present invention provides a dovetailed joint that is particularly useful in detachably connecting the cylindrical typing element and the follower arranged over the lead screw that permits the typing assembly to be removed from the splined shaft. Additionally, the present invention teaches a structure that permits simple and easy disconnecting of this splined shaft from the typing assembly, so that the type rings may be removed easily for replacement, repair, or substitution of a different type font.

The present invention also teaches an improved type actuator, wherein a slidable hammer is specially shaped and formed within a block of synthetic material to provide ease of operation.

Accordingly, it is the object of the present invention to provide improved linkages and retaining structures, as well as an actuating hammer for use in specialized automatic typing equipment.

The manner in which this and other objects of the present invention are accomplished will be seen from the following detailed description.

DETAILED DESCRIPTION OF THE INVENTION

Figure 1:
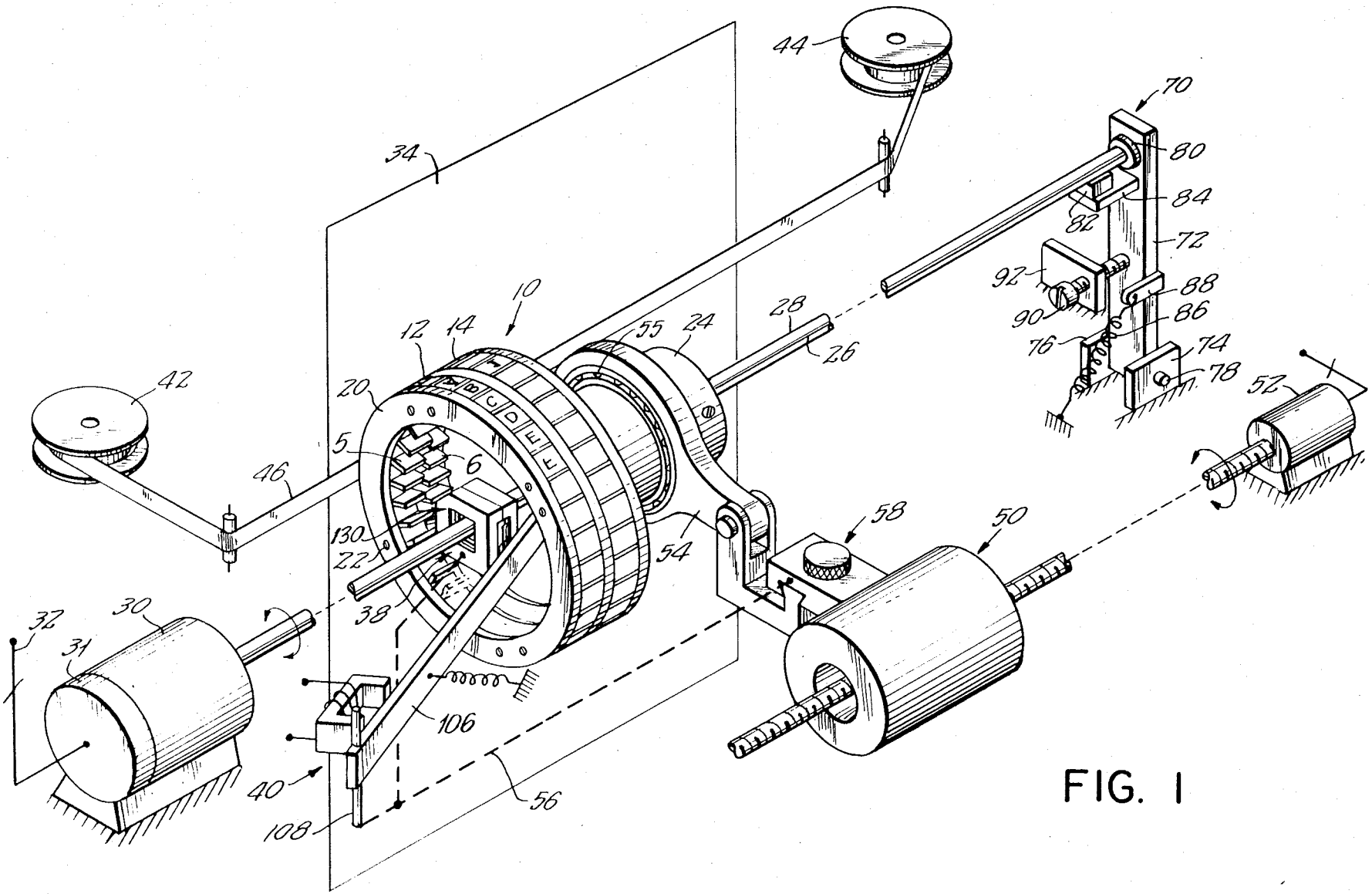
FIG. 1 is a perspective view, in partial schematic form, of an automatic typing machine employing the apparatus of the present invention.

In FIG. 1, the entire automatic typing assembly is shown and, specifically, the cylindrical printing apparatus has two axially arranged annular rings in which the type elements, 5 and 6 for example, are arranged. Printing assembly 10 is formed having a first print ring assembly 12 concentrically arranged in contact with the second print ring assembly 14. The print rings 12 and 14 are arranged in a mutually staggered relationship. In order to retain the sliding type characters in the slots of the first sloted print ring 12, a retaining plate 20 is affixed to assembly 12 by screws 22. The second print ring 14 has the type elements arranged in slots and retained by a flat surface of the first ring 12 and this assembly 14 is fixed to a hub 24 that contains linear bearings which interact with slots or grooves in the main driveshaft 28, one such groove being seen at 26. This driveshaft 28 is the splined shaft referred to above. The shaft 28 is rotated under action of a rotary index motor 30 that includes an encoder 31 to provide angular positional information. Energization of the motor is under the control of an onboard computer or microprocessor via signals on multiple lines 32. Rotation of shaft 28 causes the type rings 12 and 14 to rotate and, thus, indexing to the desired character is provided.

Once the print ring assembly 10 is rotated by the shaft 28 and motor 30 to the desired character, a solenoid hammer assembly 40 is energized so that the movable portion of the inventive actuator 38 is driven toward the paper 34 and the front of the movable portion of the actuator 38 strikes the shank of a type character in the appropriate ring and causes the imprint on the paper 34. A tape transport assembly having two driven reels, 42 and 44, moves the conventional typewriter ribbon 46 between the paper 34 and the rotating print drum assembly 10. The construction of the inventive actuator assembly 38 is shown in detail in FIG. 4 discussed below.

Lateral or translational movement of the print ring assembly 10 is accomplished by a lead screw and follower assembly 50 with rotary motion to the lead screw being provided by a servo-motor 52. The manner in which the translational motion is coupled to the printing assembly 10 from the follower assembly 50 is a feature of the present invention and provides a rigid and firm connection, yet one that is easily disassembled in order to remove the print ring assembly 10 from the shaft 28. This is shown in detail in FIG. 2, discussed below. The hub 24 of the print ring assembly 10 includes ball bearings, shown typically at 55, that permit mutual rotation between the hub 24 and the yoke 54 and also serves to absorb side loading caused by the laterial motion. The actuator hammer assembly 38 and solenoid assembly 40 travel with the print assembly 10 and are mechanically connected thereto. This mechanical connection is represented schematically by the dot and dash line 56.

The automatic typing apparatus shown in FIG. 1, and specifically the rotary printing drum assembly 10, is intended to be a removable assembly in order to permit changing the print ring bearing the various type characters. To that end, the dovetail arrangement shown at 58 permits the disconnection of the printing assembly 10 from the lead screw follower 50. The manner in which the type rings of the printwheel assembly are disassembled is the subject of my co-pending application Ser. No. 407,841, filed Aug. 13, 1982.

In order to slide the rotary printing assembly 10 off the driven shaft 28, it is necessary to free one end of the shaft 28. The present invention teaches a pull-down assembly, shown generally at 70, in FIGS. 1 and 3, that permits the end of the shaft 28 to become free. The movable pull-down assembly 70 includes a vertically arranged plate member 72 that is pivotally mounted at its base by tabs 74, 76 to the main frame of the assembly. Tabs 74, 76 have holes formed therein through which pins formed on plate 72 protrude, one of which is seen at 78 and thus provide the appropriate bearing surfaces. The plate 72 has a bushing 80 arranged therein that provides a suitable bearing surface for the end of shaft 28. Note that shaft 28 rotates at a relatively high speed as driven by the servo-motor 30. In order to provide some damping to cut down excessive vibrations of the shaft 28 and to prevent any high frequency noise or squeal, slight drag is provided to shaft 28 in the form of a brake pad 82 that is mounted to be in rubbing or frictional contact with shaft 28 by means of a cantilevered mounting element 84 that is fixed to plate 72. The plate assembly 70 is biased into contact with the shaft 28 by means of a tensioning spring 86 that is secured to the frame of the machine at one end and to a tab 88 mounted below the mid point of plate 72. The operation of the assembly 70 is then such that upon swinging the plate 72 in an outward direction, shaft 28 is freed from bushing 80 and because the spring 86 is attached to tab 88 below the midpoint of plate 72 upon swinging it in an outward direction it will stay outward in release postion, shown in dash lines in FIG. 3. In order to positively locate the plate 72 in its upward or hold position, an adjusting screw 90 is provided that is threadedly engaged in a plate 92 mounted to the frame of the assembly. By adjusting screw 90 inwardly and outwardly, the shaft hold position of plate 72 can be accurately controlled.

Figure 2:
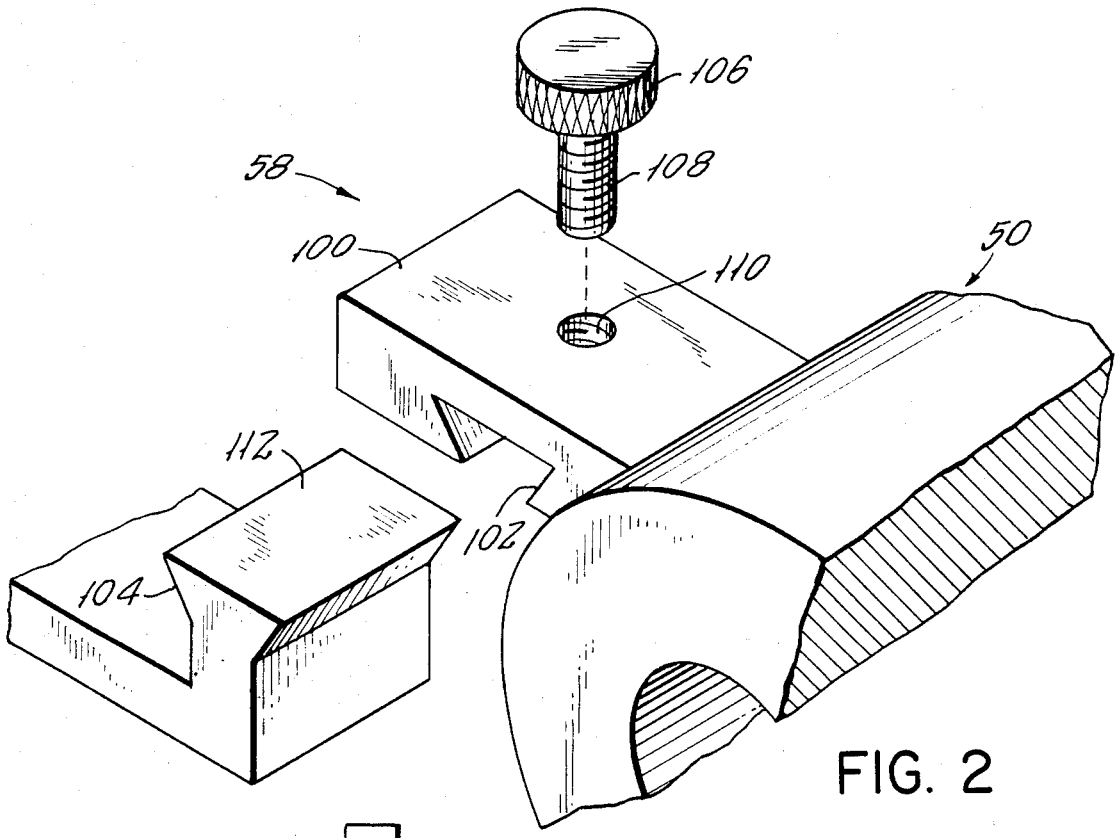
FIG. 2 is a detail, in exploded form, of a specialized linkage assembly provided by the present invention.

Referring now to FIG. 2, the dovetail joint of the present invention is shown in exploded view. As is indicated above, the present invention requires an extremely rigid and true joint that does not have a large amount of play, but one which also must be easily disassembled. Accordingly, the present invention teaches a dovetail joint having a bar element 100 either firmly attached to or integrally formed with the follower assembly 50 which literally moves along the lead screw assembly and forming in this bar assembly 100 a mortise 102. Compatible with this mortise is a tenon 104 that fits into the mortise with close tolerance; i.e., is not sloppy in the mortise 102. In order to lock the tenon 104 and the mortise 102, a thumb screw 106 is provided, shown herein as having a knob, but which may be of the wing nut construction. The threaded portion of the locking screw 108 fits into a tapped hole 110 in bar element 100 and, thus, the end of the threaded portion 108 will contact the upper flat surface 112 of the tenon 104 and lock it into the mortise 102.

Figure 3:
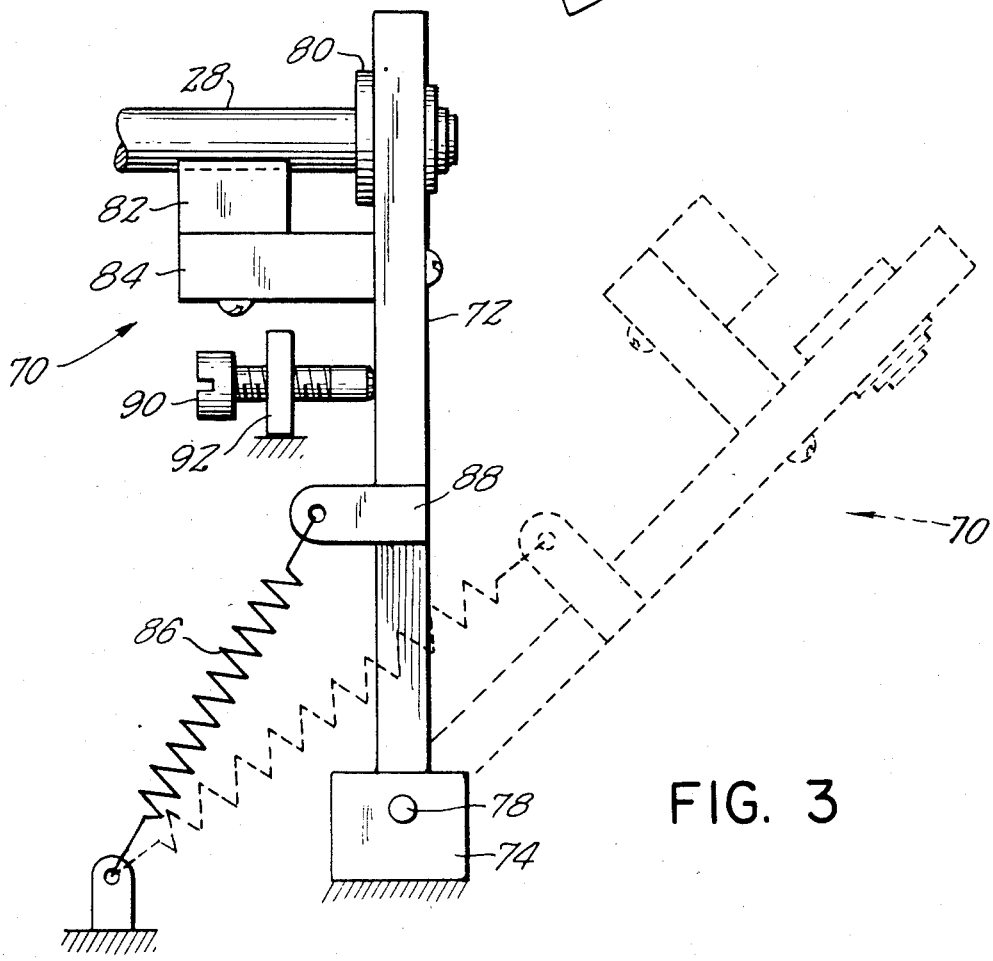
FIG. 3 is a side elevation of a specialized shaft mounting and bearing arrangement of the present invention.

Referring now to FIG. 3, a side elevational view of the shaft retaining assembly 70 of FIG. 1 is shown. What is specifically intended to be shown in this figure is the pivoting action of plate 72 as pin 78 turns in the mounting tab 74. Shown in dashed lines in FIG. 3 is the shaft retaining assembly 70 pivoting out of the way in order to permit the typing assembly 10 to be removed from shaft 28. It is understood, of course, that the appropriate tolerances and locations of the various elements such as the amount of protrusion of shaft 28 through bushing 80 and the location and the manner in which the block 82 abuts shaft 28 may be adjusted in order to permit the assembly to swing into the position shown in dashed lines in FIG. 3. In order to effect such pivoting operation of plate 72, it may be advantageous to mount the brake pad material 82 also by means of a wing nut or any finger manipulatable nut to permit loosening thereof to permit the swinging of the plate.

Figure 4:
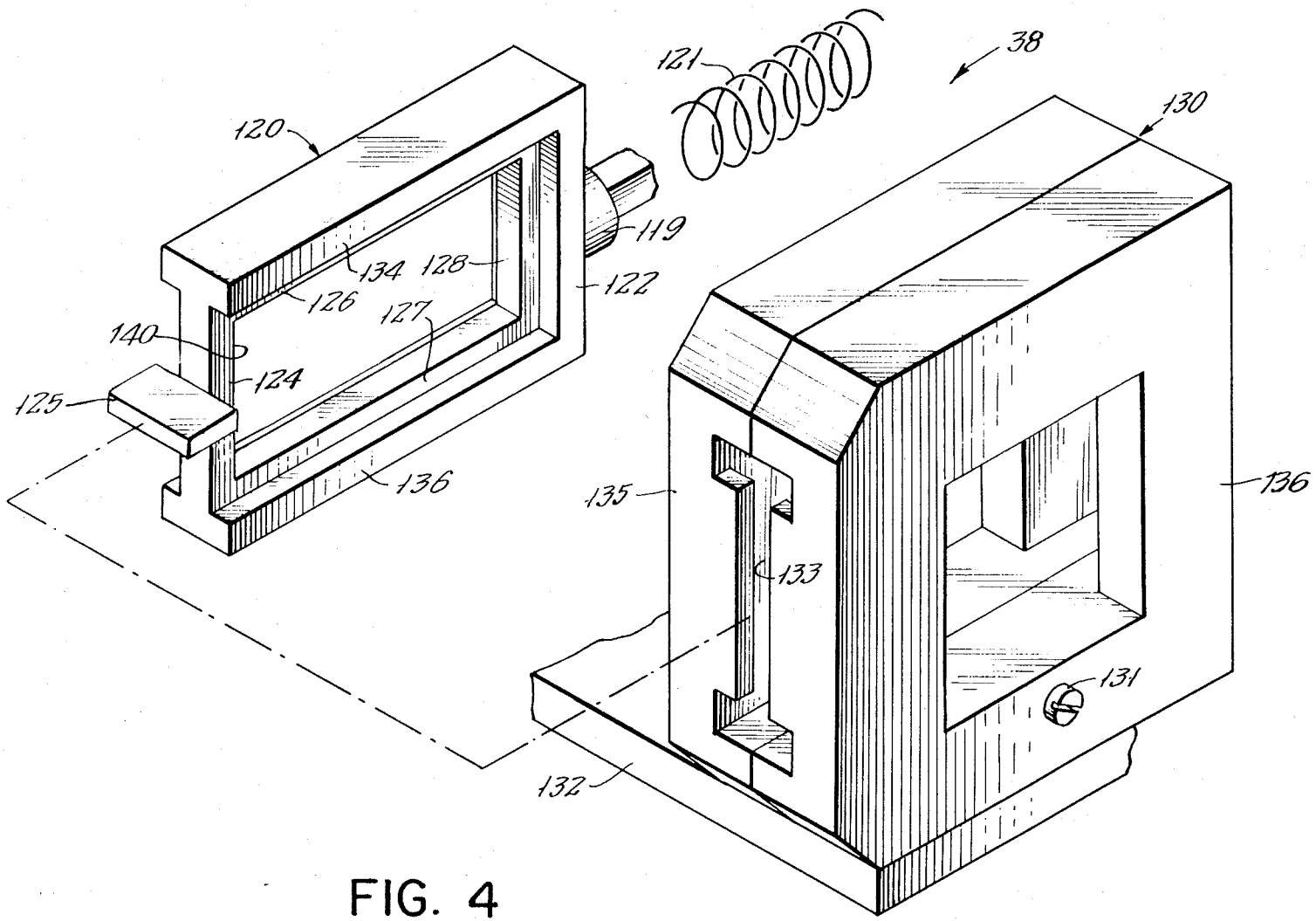
FIG. 4 is a detail perspective view in exploded form showing the invention type hammer arrangement of the present invention.

FIG. 4 shows the inventive actuator assembly 38 of FIG. 1 in an exploded view showing the internal elements thereof. The actuator assembly comprises a sliding hammer element of a special apertured construction 120 that cooperates with a compression type spring 121. The spring 121 surrounds the hammer shaft at the rear of the hammer and is secured to attachment element 119 to which the back flange 122 of the hammer is also secured. Upper and lower flanges 134, 136 extend forwardly from back flange 122 to form with the front frame portion 124 of the aperture 140 an I-shaped forward face, to which hammer head 125 is integrally secured. The upper, lower and rearward frame portions 126, 127, 128 together with forward frame portion 124 define the aperture 140.

The hammer assembly slides in a block 130 of synthetic material that is preferably formed of Delrin. The assembly of the Delrin block 130 is advantageously formed as two mirror imaged halves 135, 136 that may be bolted or screwed together with suitable fasteners, one of which is seen at 131. As is indicated in FIG. 1, the actuator assembly 38, as well as the hammer and arm, are mounted for translational motion in connection with the follower assembly 50 and this may be achieved by attaching the Delrin block 130 to a plate or the like integrally formed with the follower assembly and, specifically, integrally formed with the plate member 100 of FIG. 2. This mounting element is seen at 132 in FIG. 4. It is noted that in the actuator assembly of FIG. 4, the element which is driven; i.e., element 120, travels in a straight line; i.e., with rectilinear motion, even though it is struck by hammer 106 (FIG. 1) having arcuate motion. This is accomplished by providing I-shaped opening 133 at the forward end of the block 124 which, together with the inner surfaces of the block assembly 130, fits and directs flanges 134, 136 on the sliding element 120. The forward, strike, sliding movement of the hammer is limited by the compression spring 121 and the rearward return movement by the rear surface of hammer head 121 and the forward surfaces of block assembly 130.

Another important feature is that the mass of sliding element 120 is kept at a minimum so that large forces are not required to bring the sliding element 120 into motion; i.e., the solenoid, and spring 121 need not be excessively large to return it to its original position. Advantageously, the sliding element 120 is formed with wide aperture 140 to both minimize weight and to accommodate rotating shaft 28 throughout the strike and return travel of the sliding element 120.

What is claimed is:

1. In a typewriter printing assembly comprising means for mounting type characters, shaft means along which said mounting means is moved, actuator means for moving said type characters from an at rest mode to a typing mode and follower assembly means for moving said mounting means and said actuator means along said shaft, said actuator means being mounted around said shaft in striking relation with said type characters, means connecting said actuator means to said follower assembly for movement therewith and means connecting said mounting means to said follower assembly for movement therewith, said last mentioned means providing interfitting parts between said mounting means and said follower assembly for securing the same together and for releasing the same from one another, means adjacent an end of said shaft for releasably securing said shaft in operative position, said means connecting said mounting means and said follower assembly means comprising a mortise and tenon joint and means are provided for securing said tenon in said mortise.

2. In a typewriter printing assembly comprising means for mounting type characters, shaft means along which said mounting means is moved, actuator means for moving said type characters from an at rest mode to a typing mode and follower assembly means for moving said mounting means and said actuator means along said shaft, said actuator means being mounted around said shaft in striking relation with said type characters, means connecting said actuator means to said follower assembly for movement therewith and means connecting said mounting means to said follower assembly for movement therewith, said last mentioned means providing interfitting parts between said mounting means and said follower assembly for securing the same together and for releasing the same from one another, means adjacent an end of said shaft for releasbly securing said shaft in operative position, said means adjacent said end of said shaft comprising a plate providing a bearing for said shaft at one end and means for pivotally mounting said plate at the other end.

3. The typewriter printing assembly of claim 2, wherein friction means extend from said plate for damping movements of said shaft.

4. The typewriter printing assembly of claim 2, wherein spring means retain said plate in position for securing said shaft in operative position.

5. The typewriter printing assembly of claim 4, wherein means are provided for adjusting the arcuate position of said plate in the shaft securing position.

6. In a typewriter printing assembly comprising means for mounting type characters, shaft means along which said mounting means is moved, actuator means for moving said type characters from an at rest mode to a typing mode and follower assembly means for moving said mounting means and said actuator means along said shaft, said actuator means being mounting around said shaft in striking relation with said type characters, means connecting said actuator means to said follower assembly for movement therewith and means connecting said mounting means to said follower assembly for movement therewith, said last mentioned means providing interfitting parts between said mounting means and said follower assembly for securing the same together and for releasing the same from one another, means adjacent an end of said shaft for releasbly securing said shaft in operative position, said actuator means including a sliding hammer for actuating said type characters, said sliding hammer being formed with an aperture for receiving said shaft, said sliding hammer and said hammer support means being formed with interfitting means for supporting said hammer for rectilinear sliding movement to move said type characters, said sliding hammer and said hammer support means being formed with stop means for limiting the sliding movement of said hammer, said sliding hammer including a print striking hammer head at its forward end and said means for limiting sliding movement comprising spring means for limiting forward striking movement, and rearward, return movement is limited by the forward surface of said hammer support means and the rearward surface of said hammer head.

7. The typewriter printing assembly of claim 6, wherein said hammer support means is comprised of mirror imaged halves and means securing said halves together.

* * * * *

UNITED STATES PATENT AND TRADEMARK OFFICE

CERTIFICATE OF CORRECTION

PATENT NO. : 4,501,508

DATED : February 26, 1985

INVENTOR(S) : John T. Potter

It is certified that error appears in the above-identified patent and that said Letters Patent are hereby corrected as shown below:

Column 6, line 10, "mounting" should be --mounted--.

Column 6, line 23, after "shaft," insert --hammer support means, said hammer support means also being formed with an aperture for receiving said shaft,--.

Column 6, line 29, after "hammer," deleted "said sliding hammer".

Signed and Sealed this

*Twenty-third* Day of *July 1985*

[SEAL]

*Attest:*

DONALD J. QUIGG

*Attesting Officer*

*Acting Commissioner of Patents and Trademarks*